US009081367B2

(12) United States Patent
Forsey et al.

(10) Patent No.: US 9,081,367 B2
(45) Date of Patent: Jul. 14, 2015

(54) TIMEPIECE

(75) Inventors: Stephen Forsey, Les Brenets (CH); Robert Greubel, Lignieres (CH); Francois Trifoni, Le Locle (CH)

(73) Assignee: COMPLITIME SA, La Chaux-de-Fonds (CH)

( * ) Notice: Subject to any disclaimer, the term of this patent is extended or adjusted under 35 U.S.C. 154(b) by 259 days.

(21) Appl. No.: 13/883,338

(22) PCT Filed: Nov. 4, 2011

(86) PCT No.: PCT/EP2011/069439

§ 371 (c)(1),
(2), (4) Date: May 3, 2013

(87) PCT Pub. No.: WO2012/062659

PCT Pub. Date: May 18, 2012

(65) Prior Publication Data

US 2013/0215723 A1 Aug. 22, 2013

(30) Foreign Application Priority Data

Nov. 9, 2010 (CH) ..... 1876/10

(51) Int. Cl.
*G04B 15/12* (2006.01)
*G04B 17/28* (2006.01)
*G04B 17/06* (2006.01)

(52) U.S. Cl.
CPC ..... *G04B 15/12* (2013.01); *G04B 17/06* (2013.01); *G04B 17/28* (2013.01)

(58) Field of Classification Search
CPC ..... G04B 15/00; G04B 15/12; G04B 15/14; G04B 17/06; G04B 17/20; G04B 17/28
USPC ..... 368/124, 127, 169, 171, 175
See application file for complete search history.

(56) References Cited

U.S. PATENT DOCUMENTS 7,350,966 B2 * 4/2008 Zaugg ..... 368/140
7,677,793 B2 * 3/2010 Lete et al. ..... 368/127

(Continued)

FOREIGN PATENT DOCUMENTS

CH 697 523 B1 11/2008
CH 698 622 B1 9/2009
WO 2005/043257 A1 5/2005

(Continued)

OTHER PUBLICATIONS

International Search Report, dated Feb. 1, 2012, from corresponding PCT application.

*Primary Examiner* — Vit W Miska
(74) *Attorney, Agent, or Firm* — Young & Thompson

(57) ABSTRACT

Timepiece including a back and display element, the timepiece being inscribed between first and second mutually parallel reference planes, the first plane being tangential to the back, and the second plane lying on the same side as the display element. The timepiece contains a movement which includes a framework. The framework includes at least two components positioned one on each side of a reference axis perpendicular to the first and second planes, on each of which components there are mounted a balance and an escapement, which together respectively form a platform escapement, each balance being mounted to pivot about an axis of rotation in the corresponding component. The framework further includes at least one support element having at least one bearing surface on which at least one of the platform escapements is positioned so that the axis of rotation is inclined with respect to the reference planes and intersects them.

15 Claims, 4 Drawing Sheets

(56) References Cited

U.S. PATENT DOCUMENTS

| | | | | |
|---|---|---|---|---|
| 8,210,739 | B2 * | 7/2012 | Greubel et al. | 368/127 |
| 2008/0144447 | A1 * | 6/2008 | Ruchonnet et al. | 368/127 |
| 2008/0192583 | A1 | 8/2008 | Buttet et al. | |
| 2009/0268565 | A1 | 10/2009 | Salathe | |
| 2010/0046329 | A1 * | 2/2010 | Greubel et al. | 368/132 |
| 2010/0097899 | A1 | 4/2010 | Greubel et al. | |

FOREIGN PATENT DOCUMENTS

| | | | |
|---|---|---|---|
| WO | 2006/099882 | A1 | 9/2006 |
| WO | 2007/033513 | A2 | 3/2007 |
| WO | 2008/101802 | A2 | 8/2008 |

* cited by examiner

TIMEPIECE

TECHNICAL FIELD

The present invention relates to timepieces, more particularly of the type including a sprung balance. Such timepieces comprise a bottom and display means, and can be arranged between first and second reference planes parallel to each other, the first reference plane being tangential to said bottom, and the second reference plane being located on the side of said display means. Said timepieces contain a movement comprising a frame.

BACKGROUND OF THE INVENTION

The frame bears wheels generally positioned such that their axes of rotation are parallel to each other and perpendicular to said reference planes. These wheels, which are discoid-shaped, may more or less superimpose one another, depending on their position with respect to the frame. One of them, arranged to support the time indicator organs, is positioned near the second reference plane. Traditionally, the wheels such as the assortment (comprising the escapement wheel, the pallets and the double roller) as well as the oscillator are mounted directly on the movement, near the first reference plane. After the movement is mounted, these elements must undergo the usual adjustments, which then require manipulations of the entire movement. These adjustments may prove relatively impractical and delicate.

Furthermore, it is known to use an inclined balance so as to minimize the running variation of a watch. The complexity of the implementation (manufacture and assembly) of the balance and the assortment is then increased.

Another technique consists of mounting the balance in a tourbillon, or a double-tourbillon as for example described in patent CH698 622, but this type of construction is not part of the invention, which relates to "simple" balances whereof the staff is mounted on an element of the frame and not a tourbillon frame.

Furthermore, the incline angle of the balance mounted on the frame is chosen so as to minimize the running variation when worn, i.e., when the watch is used and is either on the wearer's wrist in the case of a bracelet watch or in the wearer's pocket in the case of a pocket watch.

However, the watch is not necessarily always worn, for example at night or when the wearer is using another watch. The duration during which the position of the watch is not modified may cause the running thereof to vary. It therefore appears necessary to minimize the running variation also when the watch is not worn or stays in the same position for a certain amount of time.

BRIEF DESCRIPTION OF THE INVENTION

The present invention in particular aims to enable the production of a timepiece making it possible to minimize the operating variation when it is not worn or when it remains in the same position for a length of time capable of varying its operation.

The present invention also makes it possible to obtain a minimized running variation, which is also as constant as possible irrespective of the position of the timepiece when it is not worn, without, however, harming the running variation of said timepiece when it is worn.

To that end, the timepiece comprises a bottom and display means, said timepiece being arranged between first and second reference planes that are parallel to each other, the first reference plane being tangential to said bottom, and the second reference plane being located on the side of the display means. Said timepiece includes a movement comprising:

- a frame,
- at least two balances,
- at least two escapements respectively maintaining a balance,
- at least one energy source,
- going train wheels connecting said at least one energy source to the escapements.

According to the invention, the frame comprises at least two organs positioned on either side of a reference axis perpendicular to the first and second reference planes, on each of which organs a balance and an escapement are mounted, which together respectively form a platform escapement, each balance being mounted pivoting around an axis of rotation of the corresponding organ. Furthermore, the frame comprises at least one support element having at least one bearing surface on which at least one of said platform escapements is positioned such that the axis of rotation of the balance of said platform escapement is inclined with respect to said reference planes intersecting them, the intersection of the axis of rotation of the balance with the first reference plane being closer to the reference axis than the intersection of said axis of rotation with the second reference plane.

According to one alternative embodiment, the platform escapements may be positioned such that the axes of rotation of their balances are inclined with respect to one another.

According to one alternative embodiment, the frame may comprise at least two support elements respectively comprising a bearing surface, the platform escapements being positioned respectively on said bearing surfaces such that the axis of rotation of each balance is inclined with respect to said reference planes intersecting them, the intersection of their respective axes of rotation with the first reference plane being closer to the reference axis than the intersection of said axis of rotation with the second reference plane.

Advantageously, the support element may comprise a bearing surface that is inclined relative to said reference planes and intersecting them, the intersection of the plane of said bearing surface with the first reference plane being further from the reference axis than the intersection of said plane of the bearing surface with the second reference plane, and on which a platform escapement is positioned such that the angle between the axis of rotation of its balance and the first reference plane is strictly smaller than 90°.

The support element may be a bar fixed on a bottom plate or may be a single piece with a bottom plate.

Advantageously, at least one of the platform escapements may comprise a base with a rectangular transverse cross-section.

Preferably, each platform escapement comprises a balance cock, the associated balance being mounted pivoting between the base and said balance cock, and each platform escapement may comprise at least one escapement bar, the associated escapement being mounted pivoting between the base and said escapement bar.

According to one alternative embodiment, the axes of rotation of the wheels of the going train may be inclined with respect to the reference planes.

According to another alternative embodiment, the axes of rotation of the wheels of the going trains may be perpendicular to the reference planes.

Advantageously, said at least one energy source may be formed by at least one barrel, each balance and said barrel being inclined with respect to the reference planes and with respect to one another.

In order to minimize the running variations between the different positions of the timepiece, while having a balance with a large enough diameter for its moment of inertia to impart good regulating qualities to the movement, the axis of rotation of at least one balance forms an angle comprised between 10° and 80°, preferably between 30° and 60° with a perpendicular to the reference planes.

BRIEF DESCRIPTION OF THE DRAWINGS

The invention will be better understood upon reading the following description, provided as an example and done in reference to the drawings, in which.

DETAILED DESCRIPTION OF THE INVENTION

Figure 1:
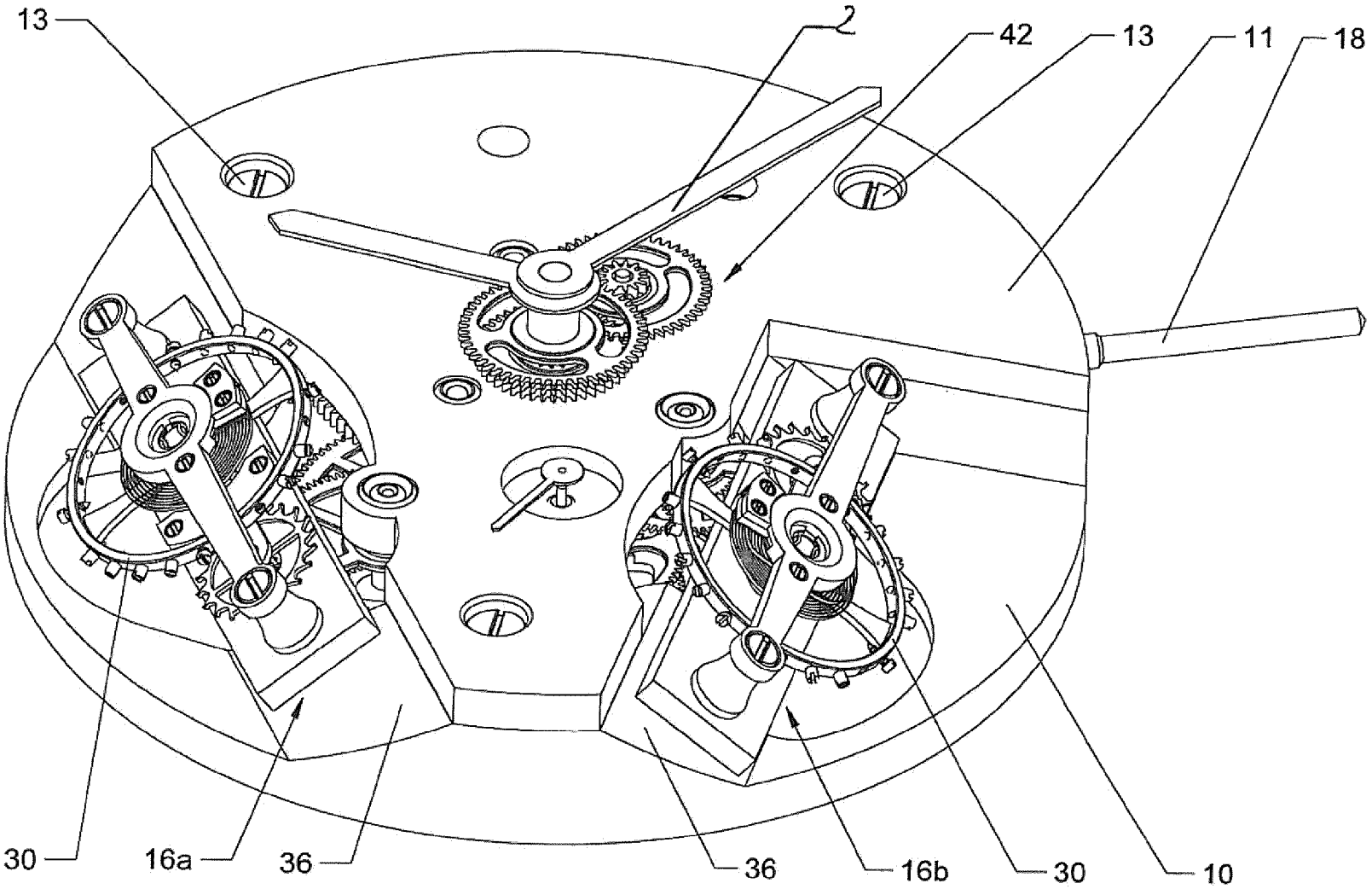
FIG. 1 shows an isometric view of a movement of a timepiece according to the invention.
Figure 2:
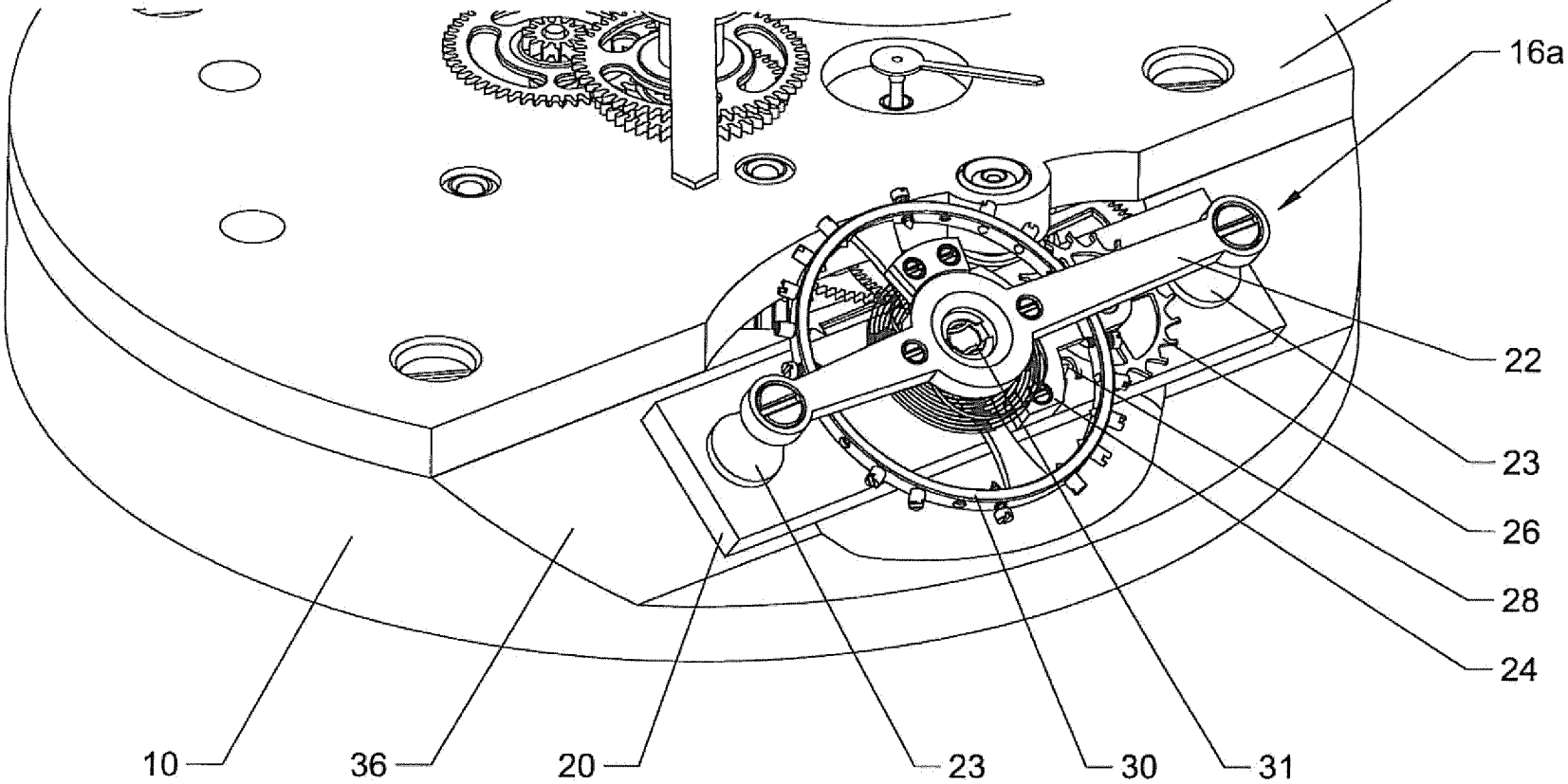
FIG. 2 shows a detailed view of FIG. 1.
Figure 3:
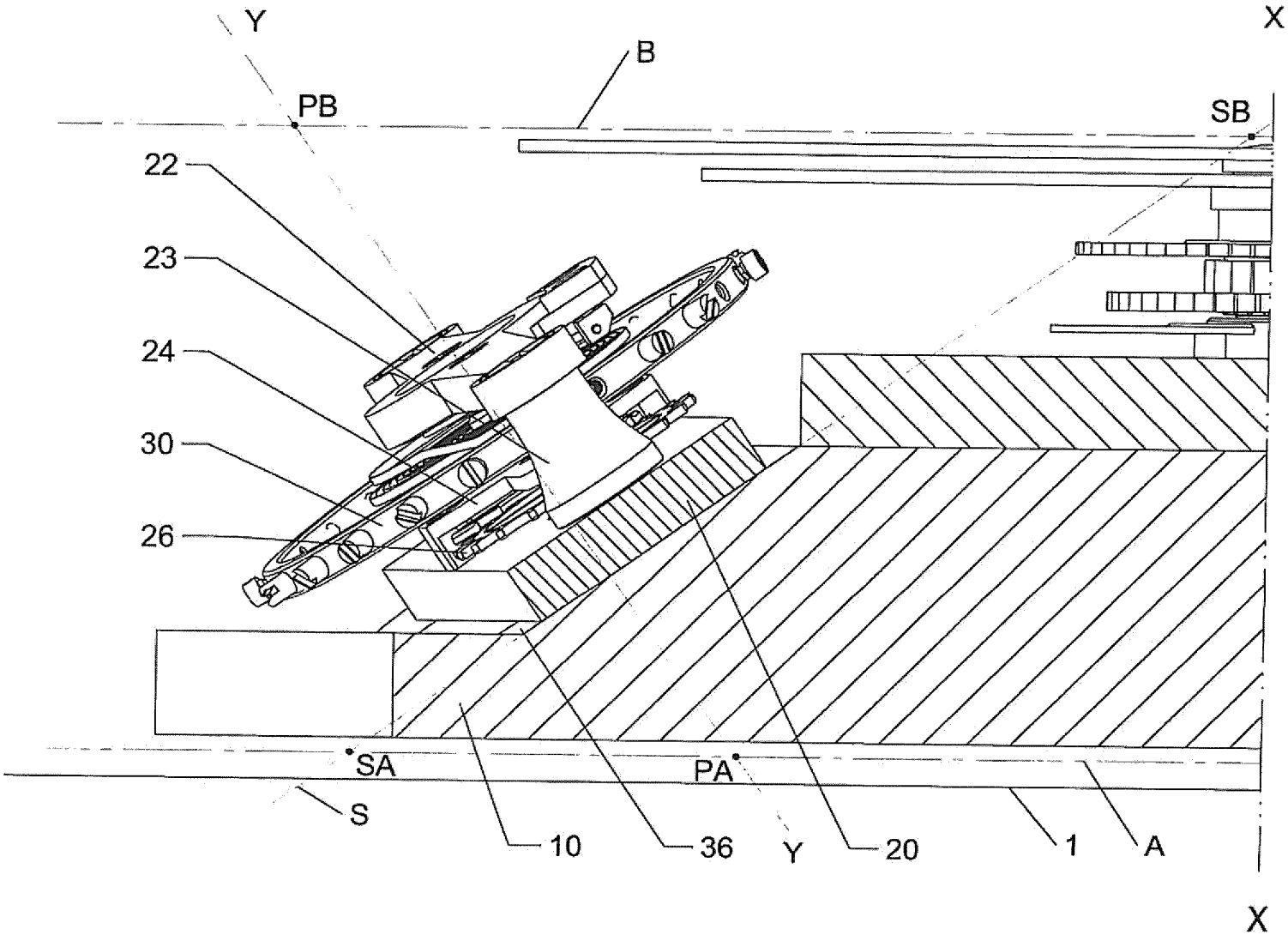
FIG. 3 is a cross-sectional view of FIG. 2.

In reference to FIGS. 1 to 4, the present invention relates to a timepiece comprising a bottom, diagrammatically shown by the line 1 in FIG. 3, and display means 2 here made up of hands. A first reference plane A and a second reference plane B are virtually described between which the timepiece is arranged. The first and second reference planes A and B are parallel to each other, and the first reference plane A is chosen to be tangential to the surface of the bottom 1 of the timepiece. When the bottom is substantially flat and essentially defines a flat surface, this means that the reference plane A is parallel to that flat surface. When the bottom is not flat, the reference plane A is parallel to the plane formed by the points of the surface of the bottom that would be in contact with a flat surface on which the timepiece would have been placed, the display means 2 being oriented toward the user. The second reference plane B is positioned on the side of the display means 2.

Thus, in the particular case of a bracelet watch, the reference planes A and B will be parallel to the surface of the wrist of the wearer, the plane A being adjacent to the wrist of the wearer and the plane B being furthest from the wrist of the wearer.

The timepiece also comprises a movement in particular including, in the alternative as illustrated, an upper bottom plate 10 and a lower bottom plate 11 and fixed on the upper bottom plate 10 using screws 13, a barrel 12 (cf. FIG. 4) forming the energy source, two going trains 14*a*, 14*b* (cf. FIG. 4), two regulating organs respectively formed by a platform escapement 16*a*, 16*b*, and a winding and setting mechanism in particular comprising a setting stem 18, the only component visible in these figures. The upper bottom plate 10 has a generally discoid shape and defines the reference axis XX (FIG. 3). The reference axis XX may more generally be an axis of symmetry, or an axis passing through the center of gravity of the timepiece for example, and is perpendicular to the reference planes A and B.

In this movement, the barrel 12 and the components of the going trains 14*a*, 14*b* rotate around axes parallel to the axis XX.

In order to simplify this description, the same references will be used indifferently for the elements of either of the platform escapements 16*a*, 16*b*, except when it is necessary to differentiate between the elements of the different platform escapements.

In reference more specifically to FIGS. 2 and 3, each platform escapement 16*a* or 16*b* comprises a base 20 and, fixed on the latter part using screws (not referenced), a through balance cock 22, two columns 23 inserted between the base 20 and the balance cock 22, and a platform escapement 24. The number of columns may of course vary. It is also clear that the balance cock may not be a through balance cock and may then be fixed by a single column. Likewise, the escapement bar may not be a through escapement bar. An escapement wheel 26 and a pallet 28, together forming the escapement mechanism of the watch, are mounted pivoting between the base 20 and the escapement bar 24. Any other type of escapement may be used. This mechanism ensures the maintenance of a sprung balance 30 comprising a staff pivotably mounted between the base 20 and the balance cock 22, around an axis of rotation YY (FIG. 3), in bearings 31 respectively mounted in the base 20 and the balance cock 22, only the bearing associated with the cock 22 being visible in the drawing. These bearings are advantageously of the shockproof type.

The upper bottom plate 10, the lower bottom plate 11, the base 20, the balance cock 22 and the escapement bar 24 make up the main components of the frame of the movement, the base 20, the balance cock 22 and the escapement bar 24 being elements of the platform escapement.

The outer surfaces of the upper bottom plate 10 and the lower bottom plate 11 are parallel to the reference planes A and B (FIG. 3), and perpendicular to the reference axis XX.

According to the present invention, the frame comprises, on either side of the reference axis XX, two support elements each having a bearing surface 36. In the illustrated alternative, the support elements are made in a single piece with the upper bottom plate 10. In another alternative not shown, the support element may be made up of a single bar fixed on the frame, and having a bearing surface as defined below. A bar/bottom plate combination having an inclined surface may also be provided.

Positioned on each bearing surface 36 is a platform escapement 16*a*, 16*b*, such that the axis of rotation YY of the balance 30 of said platform escapement 16*a*, 16*b* is inclined relative to said reference planes A, B and intersecting them, the intersection PA of the axis of rotation YY with the first reference plane A being closer to the reference axis XX than the intersection PB of said axis of rotation YY with the second reference plane B, the axes of rotation of the balances 30 being inclined with respect to one another.

More specifically, the bearing surface 36 is inclined with respect to the reference planes A and B, and intersecting them, the intersection SA of the plane S, defined by the bearing surface 36, with the first reference plane A being further from the central axis XX than the intersection SB of said plane S of the bearing surface 36 with the second reference plane B, the angle between the axis of rotation YY of each balance 30 and the first reference plane A being strictly smaller than 90°.

Typically, at least one of the axes of rotation YY is inclined by 10° to 80°, preferably from 30° to 60° with respect to a perpendicular to the planes A and B, the incline depending on the characteristics of the movement. For example, one of the axes of rotation YY may be inclined by 45°±5° with respect to a perpendicular to the planes A and B. Of course, other construction parameters may also come into play to define this incline, such as the bulk.

Furthermore, according to one preferred alternative, on each bearing surface 36, a platform escapement 16*a* or 16*b* is positioned such that the axis of rotation YY of its balance 30 is perpendicular to the plane S of said bearing surface 36, the platform escapements being positioned such that the axes of rotation YY of the balances 30 are inclined with respect to one another.

This means that, in this particular case, the balance 30 and the components 26 and 28 of the escapement rotate around axes inclined with respect to the planes A and B of the movement, the angle between the axis YY and the plane B being equal to the angle between the plane S defined by the bearing surface 36 and a perpendicular to the planes A and B.

It is clear that, according to other alternatives not shown, the axes of rotation of the balance 30 and the escapement may not be perpendicular to the plane S of the bearing surface 36, the orientation conditions according to the present invention nevertheless be respected.

As shown in FIG. 2, the base 20 has a rectangular transverse cross-section. This means that the base 20 comprises an upper face, on the balance side 30, and a lower face, designed to rest on the bearing surface 36, the upper face being parallel to the lower face. The axes of rotation of the balance 30 and the escapement wheel 26 are parallel to each other and perpendicular to the upper and lower faces of the base 20. The base 20 may be a solid piece with a parallelepiped shape. In other alternatives not shown, the base may have cutouts so as to form a central support for the balance and the assortment, and lateral brackets for fixing the platform escapement on the bearing surface.

The base 20 is kept on the bearing surface 36 using guide and fastening elements positioned in holes serving as housings provided in said bearing surface 36.

The elements of the frame, such as the upper bottom plate 10 and the lower bottom plate 11, have hollows and cutouts suitable to more particularly allow the rotation of the balances 30.

The assembly of the movement described above begins by placing bearings and guide and fastening elements. Next, the mechanisms and the train are mounted on the upper bottom plate 10. In parallel, the components of the platform escapement 16 are assembled and adjusted. The latter is then placed on the upper bottom plate 10, as the final operation. If necessary, the running of the timepiece may still be adjusted.

The present invention makes it possible to move the elements of the assortment of the balance on their respective platform escapement, outside the movement, and to perform the adjustment, the axes of the balance and the elements of the assortment in principle being vertical. This makes it possible to eliminate the incline of the balances once they are mounted on the bearing surfaces.

FIG. 3 shows another advantage that can be drawn from a configuration like that of the described movement. By placing the balances 30 inclined according to the invention, the guide and fastening elements of the base of the platform escapement are positioned toward the inside of the movement. Thus, it is possible to position the platform escapements and therefore the balances 30 near the periphery of the upper bottom plate, without being limited by the positioning of the guide and fastening elements in the upper bottom plate. As a result, the center of the movement is available to place other elements.

Furthermore, because the balances 30 are inclined relative to the planes A and B, the variations between the vertical positions and the horizontal positions are reduced. In fact, when the watch is in the horizontal position, i.e., the planes A and B are horizontal, the axes of the balances are inclined. Furthermore, when the watch is placed in a vertical position, the axes of the balances are also inclined and not horizontal as in traditional watches. Additionally, when the watch is not worn and in a fixed position, the unfavorable position of one of the balances is compensated by the favorable position of the other balance to reduce the running variations. In this way, the measured instantaneous rates are improved irrespective of the positions of the watch (worn or not worn).

Furthermore, using a platform escapement makes it possible to guarantee practical interchangeability.

Moreover, the base of the platform escapement having a rectangular transverse cross-section, its construction is consequently simplified. The incline of the balances is nevertheless obtained by for example producing inclined bearing surfaces on the upper bottom plate, which generally requires more operations than the other pieces of the movement.

Figure 4:
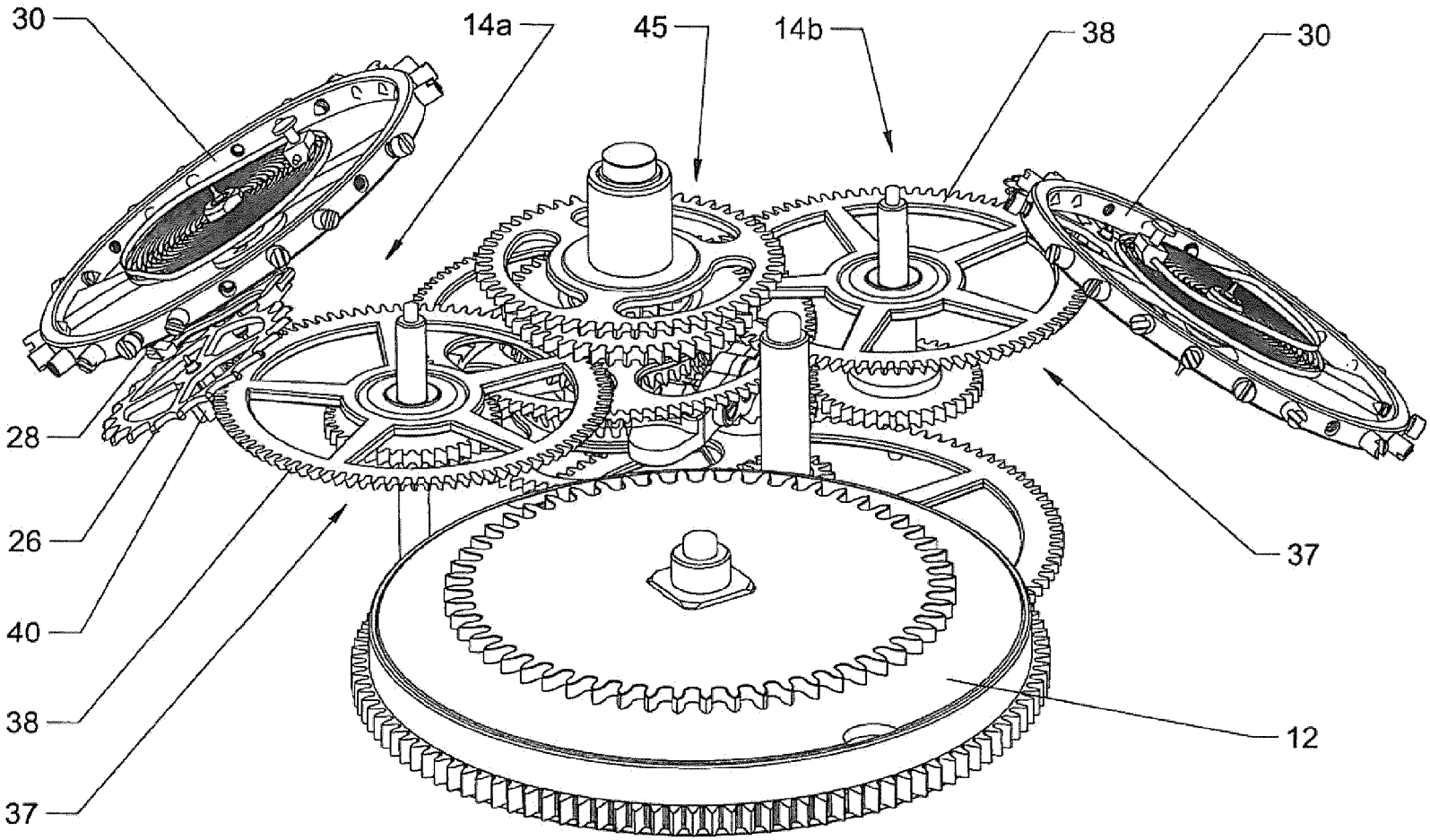
FIG. 4 diagrammatically shows the different elements of the movement of the timepiece according to the invention, without the frame.

As shown in FIG. 4, for each going train 14*a*, 14*b*, a correct connection between the going train 14*a*, 14*b*, respectively, and more particularly its second wheel 38, with the escapement pinion 40 of the escapement wheel 26 is ensured owing to the fact that the plate of the second wheel 38 has an inclined toothing. It is also possible to provide an opposite configuration, i.e., an inclined toothing formed on the escapement pinion. It is also possible to provide a combination of these configurations, i.e., an inclined toothing made on the escapement pinion and simultaneously an inclined toothing on the plate of the second wheel.

In the illustrated alternative embodiment, the movement comprises a single energy source and the going trains 14*a* and 14*b* comprise a differential gear 45 which drives the two second-wheels and pinions 37, which respectively drive an escapement pinion 40.

According to another alternative not shown, the movement may comprise as many energy sources as there are going trains each associated with said energy sources, the going trains then being independent of one another.

Furthermore, the going train wheels may directly or indirectly connect the energy source(s) to the escapements. In particular, other intermediate trains may be provided between the going train and the energy source.

In this movement, the two balances 30 are inclined relative to the axes of rotation of the wheels of the going train in particular. In an alternative that is not shown, only one of the balances may be inclined, the frame then comprising a single support element on which the platform escapement bearing the inclined balance is positioned.

Such a configuration makes it possible to reduce the running variation in the different positions of the movement, in particular when the watch is not worn, the two balances never being in the horizontal position at the same time.

Furthermore, the construction according to the invention makes it possible to keep the penetration depth of the toothing constant between the second wheel and the escapement pinion, even in case of variation in the height of the platform escapement on the movement.

As shown in FIG. 1, the display is done using wheels whereof the axis is perpendicular to the plane A. To that end, the movement bears a motion-work 42 known by those skilled in the art and that will not be described here in more detail. Furthermore, the display means may be different from hands, i.e., drums, discs, or any other means known by those skilled in the art.

The movement according to the invention may be subject to any other alternatives without going beyond the scope of the invention.

In particular, the described examples show that the bearing surface 36 is inclined relative to the reference planes A and B by the desired incline angle, the base 20 of the platform escapement having a rectangular transverse cross-section. However, according to other alternative embodiments not shown, the bearing surface of the support element may of course be flat, the platform escapement, and in particular the base thereof, having a geometry allowing the axis of rotation (YY) of the balance of said platform escapement to be inclined relative to the reference planes (A, B) and intersecting them, the intersection of the axis of rotation (YY) with the first reference plane (A) being closer to the reference axis (XX) than the intersection of said axis of rotation (YY) with the second reference plane (B). Likewise, the bearing surface of the support element may be inclined, the platform escapement, and in particular the base thereof, having a geometry allowing the axis of rotation (YY) of the balance of said platform escapement to be inclined with respect to the reference planes (A, B) according to the desired final angle and intersecting them, the intersection of the axis of rotation (YY) with the first reference plane (A) being closer to the reference axis (XX) than the intersection of said axis of rotation (YY) with the second reference plane (B).

Furthermore, the energy source may of course include several barrels, connected to each other in series or in parallel. As explained above, the movement may include two or more balances. These balances may be positioned side-by-side or completely or partially superimposed.

Additionally, in other alternative embodiments not shown, the axes of rotation of the wheels of the going trains 14*a* and/or 14*b* as well as the axis of rotation of the barrel may be inclined with respect to the reference planes A and B. In particular, they may be inclined so as to be parallel to the axes of rotation YY of the balances 30.

The use of an upper and/or lower bottom plate is of course only one possible embodiment, simple bars being able to be used.

Thus, owing to the particular features of the different alternatives of the movement according to the invention, it is possible to produce a watch both offering particularly interesting technical features and allowing original aesthetic developments.

The invention claimed is:

1. A timepiece comprising a bottom and display means, said timepiece being arranged between first and second reference planes that are parallel to each other, the first reference plane being tangential to said bottom, and the second reference plane being located on the side of the display means, said timepiece including a movement comprising:

a frame, at least two balances, at least two escapements respectively maintaining a balance, at least one energy source, going train wheels connecting said at least one energy source to the escapements, wherein the frame comprises at least two organs positioned on either side of a reference axis perpendicular to the first and second reference planes, on each of which organs a balance and an escapement are mounted, wherein each organ, its balance and its escapement together respectively form a platform escapement, each balance being mounted pivoting around an axis of rotation of the corresponding organ, wherein the frame further comprises at least one support element having at least one bearing surface on which at least one of said platform escapements is positioned such that the axis of rotation of the balance of said platform escapement is inclined with respect to said reference planes intersecting them, the intersection of the axis of rotation with the first reference plane being closer to the reference axis than the intersection of said axis of rotation with the second reference plane.

2. The timepiece according to claim 1, wherein the frame may comprise at least two support elements respectively comprising the bearing surface, and wherein the platform escapements are positioned respectively on said bearing surfaces such that the axis of rotation of each balance is inclined with respect to said reference planes intersecting them, the intersection of their respective axes of rotation with the first reference plane being closer to the reference axis than the intersection of said axis of rotation with the second reference plane.

3. The timepiece according to claim 1, wherein the support element may comprise the bearing surface that is inclined relative to said reference planes and intersecting them, the intersection of the plane of said bearing surface with the first reference plane being further from the reference axis than the intersection of said plane of the bearing surface with the second reference plane, and on which the platform escapement is positioned such that the angle between the axis of rotation of its balance and the first reference plane is strictly smaller than 90°.

4. The timepiece according to claim 1, wherein the support element is a bar fixed on a bottom plate.

5. The timepiece according to claim 1, wherein the support element is a single piece with a bottom plate.

6. The timepiece according to claim 1, wherein at least one of the platform escapements comprises a base with a rectangular transverse cross-section.

7. The timepiece according to claim 6, wherein each platform escapement comprises a balance cock, the associated balance being mounted pivoting between the base and said balance cock.

8. The timepiece according to claim 6, wherein each platform escapement comprises at least one escapement bar, the associated escapement being mounted pivoting between the base and said escapement bar.

9. The timepiece according to claim 1, wherein the axes of rotation of the wheels of the going train are inclined with respect to the reference planes.

10. The timepiece according to claim 1, wherein the axes of rotation of the wheels of the going trains may be perpendicular to the reference planes.

11. The timepiece according to claim 1, wherein said at least one energy source may be formed by at least one barrel and wherein each balance and said barrel are inclined with respect to the reference planes and with respect to one another.

12. The timepiece according to claim 1, wherein the axis of rotation of at least one balance forms an angle comprised between 10° and 80° with a perpendicular to the reference planes.

13. The timepiece according to claim 12, wherein the axis of rotation of at least one balance forms an angle comprised 30° and 60° with a perpendicular to the reference planes.

14. The timepiece according to claim 1, wherein the movement comprises a single energy source and wherein said going trains comprise a differential gear.

15. The timepiece according to claim 1, wherein the movement comprises as many energy sources as there are going trains associated with each of said energy sources.

* * * * *